US007063546B2

(12) United States Patent
Akino

(10) Patent No.: US 7,063,546 B2
(45) Date of Patent: Jun. 20, 2006

(54) MICROPHONE CONNECTOR

(75) Inventor: Hiroshi Akino, Machida (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 11/101,476

(22) Filed: Apr. 8, 2005

(65) Prior Publication Data

US 2005/0239305 A1 Oct. 27, 2005

(30) Foreign Application Priority Data

Apr. 22, 2004 (JP) ..... 2004-126529

(51) Int. Cl.
*H01R 13/66* (2006.01)

(52) U.S. Cl. ..... 439/106; 439/620

(58) Field of Classification Search ..... 439/620, 439/106, 95, 607–610
See application file for complete search history.

(56) References Cited

U.S. PATENT DOCUMENTS 3,944,756 A * 3/1976 Lininger ..... 381/355
3,961,202 A * 6/1976 Kono et al. ..... 307/150
4,247,955 A * 1/1981 Wiedemann ..... 455/245.2
4,541,112 A * 9/1985 Kern ..... 381/113
4,670,864 A * 6/1987 Hoffmann ..... 367/198
4,799,144 A * 1/1989 Parruck et al. ..... 710/2
5,381,295 A * 1/1995 Rund et al. ..... 361/92
5,687,387 A * 11/1997 Endejan et al. ..... 710/2
5,982,253 A * 11/1999 Perrin et al. ..... 333/182
6,282,409 B1 * 8/2001 Frohlund ..... 455/575.3
6,606,260 B1 * 8/2003 Ahlstrom ..... 363/125
6,700,480 B1 * 3/2004 Moore ..... 340/445

* cited by examiner

*Primary Examiner*—Gary Paumen
(74) *Attorney, Agent, or Firm*—Manabu Kanesaka

(57) ABSTRACT

A microphone connector reliably inhibits electromagnetic waves from entering the microphone even if their frequencies are high as in the case of cellular phones or the like. The microphone connector 10A is of a three-pin type having a connector base 11 which consists of an electric insulator and a first pin for earthing, a second pin and a third pin for signals, which are penetratingly provided in the connector base. The microphone connector includes a printed circuit board placed on a connector base 11 and a shield cover 200 covering the printed circuit board 100. The printed circuit board 100 is a two-sided substrate having a shield layer on its bottom surface which layer consists of a solid pattern of a copper foil. The printed circuit board 100 has a capacitor element and a Zener diode element mounted in parallel, the capacitor element inhibiting entry of high frequencies, the Zener diode element preventing the circuit from being electrostatically destroyed. Almost the entire top surface of the substrate is covered with the shield cover 200.

3 Claims, 4 Drawing Sheets

MICROPHONE CONNECTOR

RELATED APPLICATIONS

The present application is based on, and claims priority from, Japanese Application Number 2004-126529, filed Apr. 22, 2004, the disclosure of which is hereby incorporated by reference herein in its entirety.

FIELD OF THE INVENTION

The present invention relates to a microphone connector, and more specifically, to a technique for preventing a high-frequency electromagnetic wave generated by a cellular phone or the like from entering a microphone case through the output connector of a capacitor microphone.

BACKGROUND ART

A capacitor microphone incorporates an impedance converter such as an FET (Field Effect Transistor) because of the very high impedance of a microphone unit. The capacitor microphone normally uses a phantom power source. A microphone sound signal is output via a balanced shield cable for the phantom power source.

A microphone case (in a handheld microphone, a microphone grip) is provided with a 3-pin type output connector for a connection with the balanced shield cable (see, for example, Japanese Patent Application Publication No. H11-341583). The output connector is defined in EIAJ RC-5236 "Latch Lock Type Round Connector for Acoustic Equipment". The configuration of the output connector will be described with reference to FIGS. 5 to 7.

FIG. 5 is a sectional view showing an output connector installed in a microphone case. FIG. 6 is a front view showing the connector extracted from the microphone case. FIG. 5 is a sectional view of the output connector taken along line V—V in FIG. 6. FIG. 7 is a plan view of the output connector.

The output connector 10 comprises a disk-shaped connector base 11 consisting of an electric insulator such as a PBT (polybutadiene terephthalate) resin. Three pins, that is, a first pin E for earthing, a second pin SH on a signal hot side, and a third pin SC for a signal cold side, are for example, pressed in the connector base 11 so as to penetrate it.

In connection with a handheld microphone, as shown in FIG. 5, the output connector 10 is installed in a connector housing cylinder 20 screwed at an end of the microphone grip. The microphone grip, including the connector housing cylinder 20, consists of metal such as brass. The microphone grip acts as a shield case for incorporated electric parts.

A male thread 12 is formed in the connector base 11 so as to electrically connect the first pin E for earthing to the connector housing cylinder 20 together. The male thread 12 is housed in a thread housing hole 13 drilled in the connector base 11 in a radial direction. The connector base 11 is provided with an earth terminal plate 14 having a female thread 14*a* in which the male thread 12 is screwed in the thread housing hole 13.

As shown in the plan view in FIG. 7, the earth terminal plate 14 and the first pin E for earthing are electrically connected together via a connection fixture 15. As shown in FIG. 5, a driver (not shown) is used to rotate the female thread 14*a* through a hole 21 drilled in the connector housing cylinder 20. The male thread 12 is thus abutted against the periphery of the hole 21.

Thus, the first pin E for earthing and the connector housing cylinder 20 are electrically connected together via the earth terminal plate 14 and the connection fixture 15. Further, as shown in FIGS. 6 and 7, a plate spring 16 is connected to the first pin E for earthing; the plate spring 16 contacts an inner surface of the connector housing cylinder 20. The plate spring 16 may electrically connect the first pin E for earthing and the connector housing cylinder 20 together.

While a microphone cable drawn from a phantom power source (not shown) is connected to the output connector 10, when an intense electromagnetic wave is applied to the microphone or the microphone cable, the electromagnetic wave may enter the microphone through the output connector 10. In this case, the electromagnetic wave is demodulated by an impedance converter and output by the microphone as noise of an audible frequency.

To prevent an electromagnetic wave from entering the microphone through the output connector 10, a conventional technique for connecting capacitors between the first pin E for earthing and the second pin SH for the hot side and between the first pin E for earthing and the third pin SC for the cold side; the capacitors operate so as to short-circuit high frequencies. The conventional technique further connects the second pin SH for the hot side and the third pin SC for the cold side to a microphone case such as the connector housing cylinder 20 via an inductor used to inhibit the entry of high frequencies.

This conventional technique can appropriately inhibit the entry of normal broadcasting waves, for example, electromagnetic waves of HF, VHF, UHF, or the like. However, the recent prevalence of cellular phones or the like increases opportunities to use electromagnetic waves of higher frequencies near the microphone.

Three pins E, SH, and SC are penetratingly provided in the output connector 10. However, the area between the pins is partly unshielded, so that electromagnetic waves can enter the connector through this part. Further, the contacted part of the output connector 10 to the connector housing cylinder 20 is a part of the plate spring 16, attached to the male thread 12 for fixation and/or the first pin E for earthing as described above. Therefore, this contact part has a high impedance for high frequencies and is not sufficiently earthed for high frequencies. Consequently, even if the capacitors and inductor are connected as described above so as to inhibit high frequencies, this is not sufficiently effective on high frequencies used in cellular phones or the like.

Further, the capacitors have a maximum rated voltage above which themselves may be destroyed. When totally destroyed, the capacitors lose their functions. However, if the level of the destruction is low, the functions of the capacitors are maintained to some degree. This may in turn cause noise.

SUMMARY OF THE INVENTION

It is thus an object of the present invention to provide a microphone connector that can reliably inhibit electromagnetic waves from entering the microphone even if the frequencies are high as in the case of cellular phones or the like.

To accomplish this object, the present invention provides a microphone output connector of a three-pin type having a connector base which comprises an electric insulator and a first pin for earthing, a second pin for signals, and third pin which are penetratingly provided in the connector base, the first pin being installed at an end of a conductive microphone case of a capacitor microphone so that the first pin is electrically connected to the microphone case, the connector being characterized by comprising a printed circuit board placed on an inner surface of the connector base which is located an interior of the microphone case so that the three pins are inserted through the printed circuit board and a shield cover placed on the inner surface of the base so as to cover the printed circuit board and so that the three pins are inserted through the shield cover, and in that the printed circuit board is a two-sided substrate having a shield layer formed almost all over its bottom surface located opposite the inner surface of the base, the shield layer comprising a solid pattern of a copper foil which is not electrically connected to the second or third pin but which is electrically connected to the first pin, in that the printed circuit board has a first lead and a second lead formed on its top surface in parallel with the first pin, the first lead connecting the first and second pins together, the second lead connecting the first and third pins together, each of the first and second leads having a capacitor element and a Zener diode element mounted in parallel, the capacitor element inhibiting entry of high frequencies, the Zener diode element preventing the circuit from being electrostatically destroyed, and in that the top surface of the substrate including the capacitor element and the Zener diode element is converted with the shield cover.

According to the present invention, the shield layer of the printed circuit board electromagnetically shields the areas between the three pins penetratingly provided in the connector base. Further, the capacitor element and the Zener diode element are mounted on the top surface (part mounted surface) of the printed circuit board; the capacitor element inhibits the entry of high frequencies and the Zener diode element prevents the circuit from bring electrostatically destroyed. However, since the part mounted surface is covered with the shield cover, high frequencies from wiring leading to the capacitors are prevented from being radiated to the interior of the microphone.

The present invention is also characterized in that the first and second leads have a capacitor branch and a diode branch, respectively, each of the branches being used to mount the capacitor element and the Zener diode element in parallel and being formed so that when a current flows from the second and third signal pins to the first earthing pin, the current first flows first through the Zener diode element and then the capacitor element.

Thus, when a current flows from the signal pins to the earthing pin, the current flows first through the Zener diode element and then through the capacitor element. This protects the capacitor element from electrostatic destruction, The present invention is further characterized in that the top surface of the substrate has a shield electrode formed in a peripheral portion and electrically connected via intra-through-hole wiring to the shield layer on the bottom surface of the substrate, and the shield cover is connected to the shield layer via the shield electrode.

Thus, the shield layer of the printed circuit board and the shield cover are connected together so as to provide a low impedance for high frequencies. This produces a sufficient shield effect on high frequencies used in cellular phones or the like.

DETAILED DESCRIPTION

Figure 1:
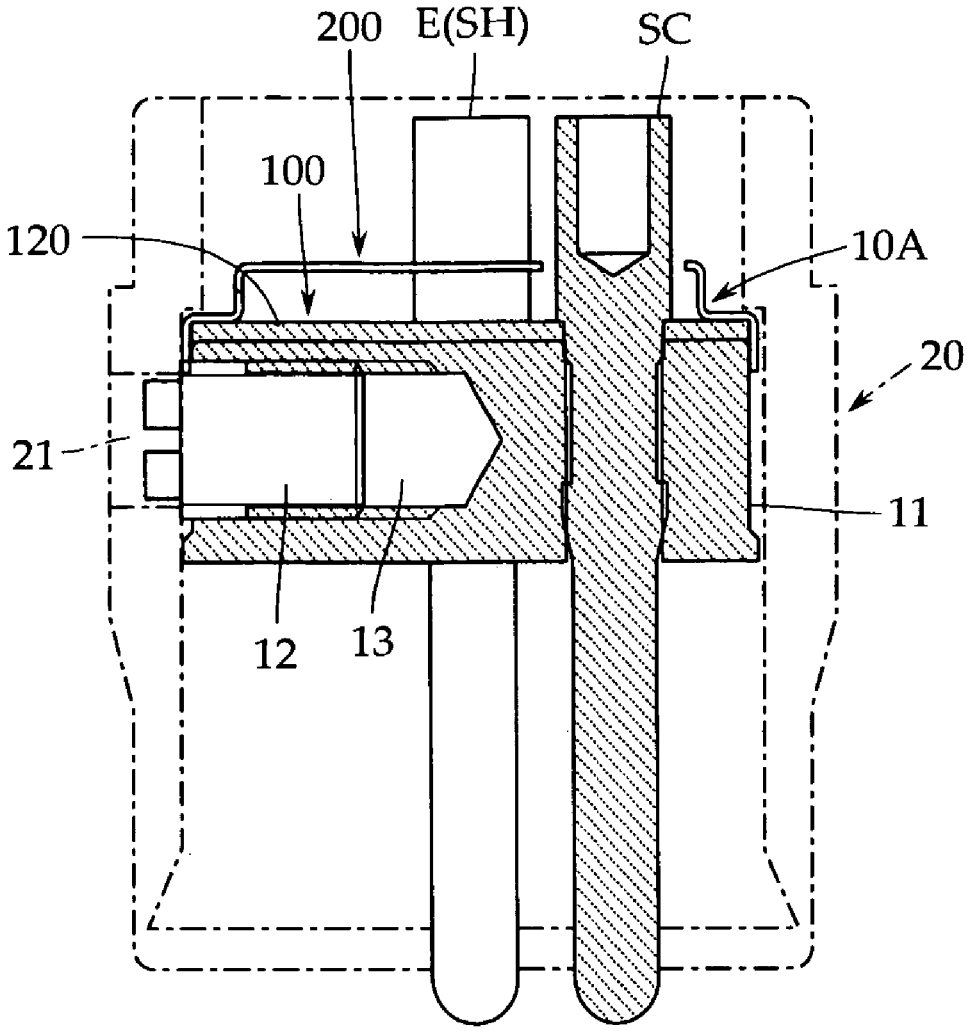
FIG. 1 is a sectional view showing an output connector according to the present invention installed in a connector housing portion shown by an alternate long and short dash line.
Figure 5:
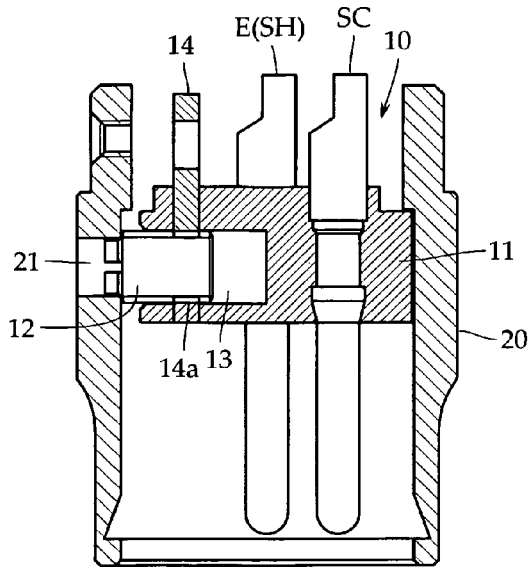
FIG. 5 is a sectional view showing a conventional output connector installed in a connector housing portion.
Figure 6:
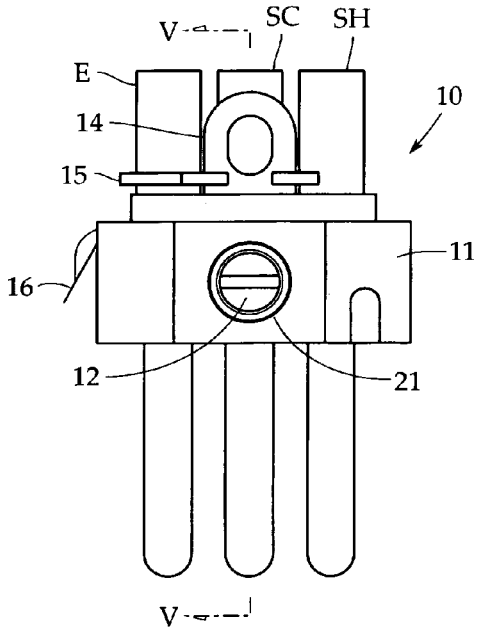
PRIOR ART FIG. 6
FIG. 6 is a front view showing the conventional output connector.
Figure 7:
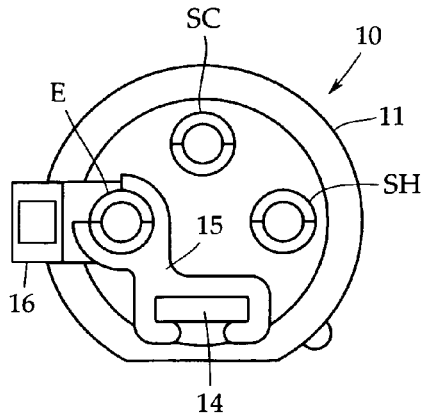
PRIOR ART FIG. 7
FIG. 7 is a plan view showing the conventional output connector.

Now, an embodiment of the present invention will be described with reference to FIGS. 1 to 4. However, the present invention is not limited to this. FIG. 1 is a sectional view of an output connector 10A according to the present invention installed in a connector housing portion 20 shown by an alternate long and short dash line. The basic configuration of the output connector 10A may be the same as that of the conventional output connector 10, described in FIGS. 5 to 7.

The output connector 10A comprises a disk-shaped connector base 11 formed of a synthetic resin such as PBT. Three pins, that is, a first pin E for earthing, a second pin SH for a signal hot side, and a third pin SC for a signal cold side, are for example, pressed in the connector base 11 so as to penetrate it. FIG. 1 is a sectional view corresponding to FIG. 5. Accordingly, in FIG. 1, the second pin SH for the hot side is placed, in the figure, closer to the reader than the first pin E for earthing.

The connector base 11 is provided with a male thread 12 used to fix the connector base 11 to a connector housing portion 20. In FIG. 1, the illustration of the following is omitted: an earth terminal plate 14 having a female thread 14*a* screwed around the male thread 12 for fixation and a connection fixture 15 that connects the earth terminal plate 14 and the first pin E for earthing together. The first pin E may be provided with a plate spring 16 that contacts an inner surface of the connector housing portion 20. For the earth terminal plate 14, the connection fixture 15, and the plate spring 16, see FIGS. 5 to 7.

According to the present invention, a print circuit board 100 and a shield cover 200 are provided on an inner surface (which faces the interior of the microphone) of the connector base 11 in order to prevent electromagnetic waves from entering the interior of the microphone (the interior of the microphone case).

Figure 2A:
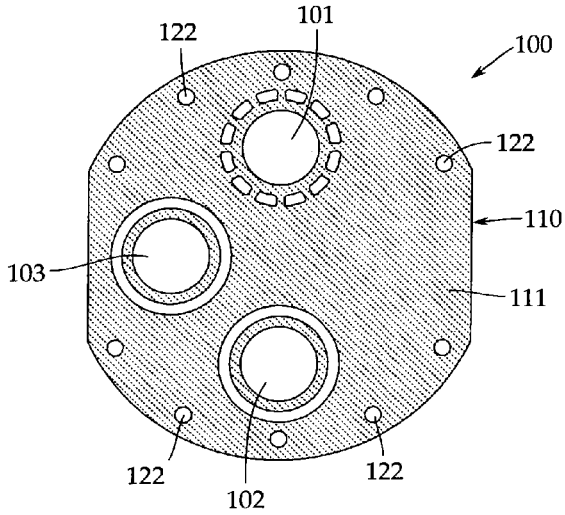
FIG. 2A is a bottom view of a printed circuit board provided in the output connector.
Figure 2B:
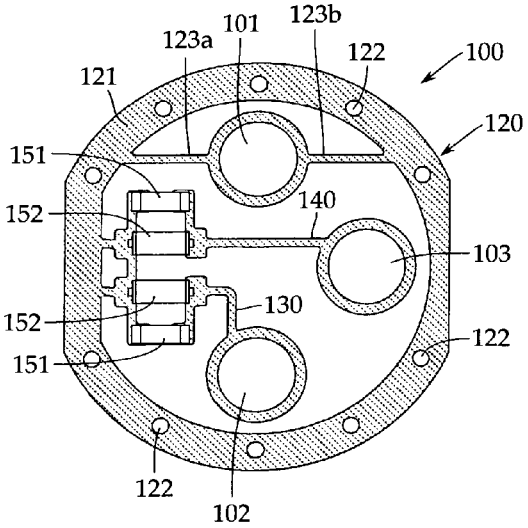
FIG. 2B is a top view showing parts mounted on the printed circuit provided in the output connector.
Figure 2C:
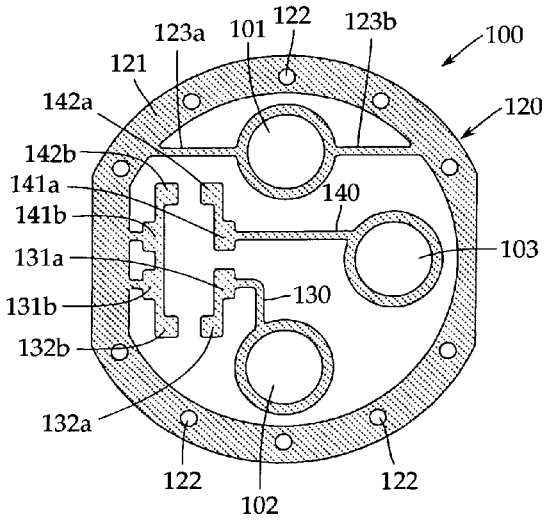
FIG. 2C is a top view showing leads of the printed circuit board provided in the output connector.

The printed circuit board 100 is a double-sided substrate. FIG. 2A shows a pattern on a bottom surface (which lies opposite the inner surface of the connector base 11) 110 of the printed circuit board 100. FIGS. 2B and 2C show a pattern on a top surface (part mounted surface) 120 of the printed circuit board 100. FIG. 2B is a top view showing parts mounted on the printed circuit board. FIG. 2C shows only leads, that is, a state observed before the parts are mounted.

As shown in FIG. 2, the printed circuit board 100 comprises three pin through-holes. Specifically, the printed circuit board 100 comprises a first pin through-hole 101 through which the first pin E for earthing is inserted, a second pin through-hole 102 through which the second pin SH for the hot side is inserted, and a third pin through-hole 103 through which the third pin SC for the cold side is inserted.

With reference to FIG. 2A, a shield layer 111 is formed almost all over the bottom surface 110 of the printed circuit board 100; the shield layer 111 is a solid pattern consisting of a copper foil. The shield layer 111 is formed all over the bottom surface 110 except for the periphery of the second pin through-hole 102 and third pin through-hole 103. The shield layer 111 blocks electromagnetic waves entering the microphone through the area between the pins of the connector base 11 after passing through for example, a microphone cable (not shown).

The shield layer 111 is not electrically connected to the second pin SH or third pin SC for signals but extends into the first pin through-hole 101 as a result of through-hole plating. Accordingly, the shield layer 111 is electrically connected to the first pin E for earthing. The interior of the second pin through-hole 102 and third pin through-hole 103 is through-hole-plated so as to be electrically connected to the pins SH and SC for signals.

With reference to FIGS. 2B and 2C, a shield electrode 121 is formed around the entire periphery of the top surface 120 of the printed circuit board 100. The shield electrode 121 and the underlying shield layer 11 are electrically connected together via a plurality of through holes 122.

The second and third pins 102 and 103 are connected in parallel with the first pin through-hole 101. However, in this example, these connections are made via the shield electrode 121. Specifically, the first pin through-hole 101 is connected to two positions of the shield electrode 121 by leads 123*a* and 123*b* extending from respective edges of the first pin through-hole 101 in opposite directions.

Figure 4:
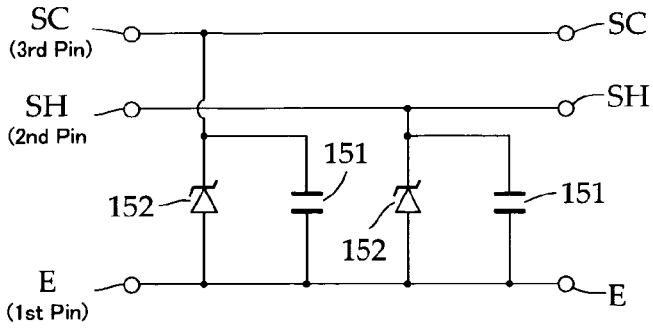
FIG. 4 is an equivalent circuit diagram of a circuit including a capacitor element and a Zener diode provided between pins of the output connector.

In contrast, the second pin through-hole 102 is connected by a lead 130 to the shield electrode 121. The third pin through-hole 103 is connected by a lead 140 to the shield electrode 121. However, in the present invention, capacitor elements 151 and Zener diode elements 152 are mounted in parallel with the leads 130 and 140. An equivalent circuit is shown in FIG. 4.

The capacitor elements 151 are used to prevent the entry of high frequencies, while the Zener diode elements 152 are used to prevent the circuit from being destroyed by static electricity. These elements are preferably chip parts that can be mounted on a surface using an automatic machine. To mount the capacitor elements 151 and the Zener diode elements 152 in parallel, the leads 130 and 140 have a capacitor branch and a diode branch.

With reference to FIG. 2C, the lead 130 has a pair of connection lands 131*a* and 131*b* formed in the middle of the lead 130 and included in the diode branch and a pair of connection lands 132*a* and 132*b* formed in the middle of the lead 130 and included in the capacitor branch. The lands 131*a* and 131*b* and the lands 132*a* and 132*b* are formed in parallel. Similarly, the lead 140 has a pair of connection lands 141*a* and 141*b* formed in the middle of the lead 140 and included in the diode branch and a pair of connection lands 142*a* and 142*b* formed in the middle of the lead 140 and included in the capacitor branch. The lands 141*a* and 141*b* and the lands 142*a* and 142*b* are formed in parallel.

When intense electromagnetic waves are applied to the microphone cable (not shown) connected to the output connector 10A, a rush current flows from the second pin SH and third pin SC for signals to the shield electrode 121. Then, the capacitor elements 151 may be destroyed.

To prevent the destruction, the length and pattern of each branch is preferably designed so that the rush current flows first through the Zener diode elements 152 and then through the capacitor elements 151. Thus, in this example, the capacitor branch extends around the diode branch to make the wiring length of the capacitor branch larger than that of the diode branch. Alternatively, it is possible to increase the thickness of the wiring for the diode branch, while relatively reducing the thickness and increasing the length of the wiring for the capacitor branch.

Figure 3A:
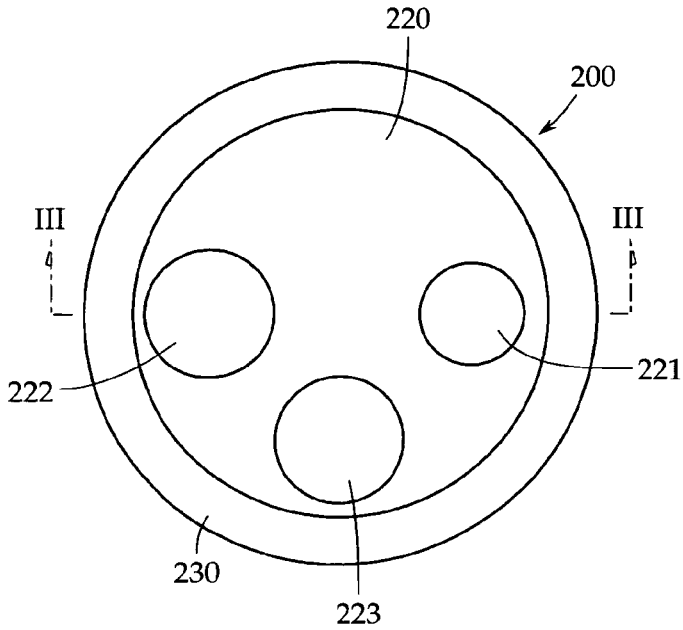
FIG. 3A is a plan view of a shield cover provide in the output connector.
Figure 3B:
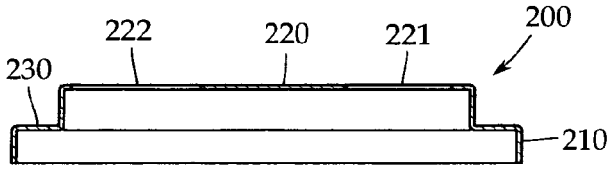
FIG. 3B is a sectional view taken along line III—III in FIG. 3A.

According to the present invention, a shield cover 200 covers the top surface 120 of the printed circuit board 100. The shield cover 200 is a pressed metal plate. FIG. 3A shows a plan view of the shield cover. FIG. 3B is a sectional view of the shield cover 200 taken along line III—III.

The shield cover 200 comprises a skirt portion 210 that fits a peripheral portion of the printed circuit board 100 and a top plate 220 that covers the entire top surface 120 of the substrate including the capacitor elements 151 and Zener diode elements 152 mounted on the printed circuit board 100. If the connector base 11 is provided with the earth terminal plate 14, shown in FIG. 5, the top plate 220 is formed so as to also cover the earth terminal plate 14.

Further, pin through-holes 221, 222, and 223 are drilled in the top plate 220 so that the first pin E for earthing and the second pin SH and third pin SC for signals are inserted through the pin through-holes. Moreover, a step portion 230 is provided between the skirt portion 210 and the top plate 220; the step portion 230 is formed by folding an upper end of the skirt portion 210 inward through almost a right angle.

When the shield cover 200 is placed on the printed circuit board 100, the step portion 230 two-dimensionally contacts the shield electrode 121, formed on the printed circuit board 100. Consequently, the shield cover 200 and the shield layer 111 are connected together so as to provide a low impedance for high frequencies.

By thus covering the upper part of the top surface 120 of the printed circuit board 100, that is, the part mounted surface, with the shield cover 200, it is possible to prevent high frequencies from the wiring extending to the capacitor elements 151 from being radiated to the interior of the microphone. The pin through-holes 221, 222, and 223 are preferably have a minimum size required to draw the respective pins out of the through-holes.

According to the present invention, by additionally providing only the printed circuit board 100 and shield cover 200 configured as described above, without the need to change the basic configuration of the output connector, it is possible to reliably prevent electromagnetic waves from entering the microphone even if their frequencies are high as in the case of cellular phones or the like.

The invention claimed is:

1. A microphone connector of a three-pin type having a connector base which comprises an electric insulator, and a first pin for earthing, a second pin and a third pin for signals, which are penetratingly provided in the connector base, the first pin being installed at an end of a conductive microphone case of a capacitor microphone so that the first pin is electrically connected to the microphone case, the connector comprising:

a printed circuit board placed on an inner surface of the connector base which faces an interior of the microphone case so that the three pins are inserted through the printed circuit board and a shield cover placed on the inner surface of the base so as to cover the printed circuit board and so that the three pins are inserted through the shield cover, wherein the printed circuit board is a two-sided substrate having a shield layer formed almost all over its bottom surface located opposite the inner surface of the base, the shield layer comprising a solid pattern of a copper foil which is not electrically connected to the second or third pin but which is electrically connected to the first pin, the printed circuit board substrate has a first lead and a second lead formed on its top surface in parallel with the first pin, the first lead connecting the first and second pins together, the second lead connecting the first and third pins together, each of the first and second leads having a capacitor element and a Zener diode element mounted in parallel, the capacitor element inhibiting entry of high frequencies, the Zener diode element preventing the circuit from being electrostatically destroyed, and the top surface of the substrate including the capacitor element and the Zener diode element is covered with the shield cover.

2. The microphone connector according to claim 1, wherein the first and second leads have a capacitor branch and a diode branch, respectively, each of the branches being used to mount the capacitor element and the Zener diode element in parallel and being formed so that when a current flows from the second and third signal pins to the first earthing pin, the current first flows first through the Zener diode element and then the capacitor element.

3. The microphone connector according to claim 1, wherein the top surface of the substrate has a shield electrode formed in a peripheral portion and electrically connected via intra-through-hole wiring to the shield layer on the bottom surface of the substrate, and the shield cover is connected to the shield layer via the shield electrode.

* * * * *